US006224155B1

(12) United States Patent
DeKraker et al.

(10) Patent No.: US 6,224,155 B1
(45) **Date of Patent: *May 1, 2001**

(54) VERTICAL HEIGHT ADJUSTMENT MECHANISM FOR CHAIRS

(75) Inventors: Larry DeKraker, Holland; Kurt R. Heidmann, Grand Rapids, both of MI (US)

(73) Assignee: Steelcase Development Inc., Grand Rapids, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/228,940

(22) Filed: Jan. 12, 1999

(51) Int. Cl.[7] ..... A47C 1/06

(52) U.S. Cl. ..... 297/344.12; 248/404; 248/161; 297/344.19

(58) Field of Search ..... 297/344.12, 344.19, 297/339; 248/631, 404, 161

(56) References Cited

U.S. PATENT DOCUMENTS

| | | | | |
|---|---|---|---|---|
| 3,547,394 | * | 12/1970 | Wehner et al. | 297/344.19 X |
| 3,711,054 | | 1/1973 | Bauer . | |
| 3,756,654 | | 9/1973 | Bauer . | |
| 3,788,587 | | 1/1974 | Stemmler . | |
| 3,837,704 | | 9/1974 | Bauer . | |
| 3,880,465 | | 4/1975 | Scheben . | |
| 4,108,416 | * | 8/1978 | Nagese et al. | 248/631 X |
| 4,373,692 | * | 2/1983 | Knoblauch et al. | 297/344.19 X |
| 4,408,800 | | 10/1983 | Knapp . | |
| 4,537,445 | | 8/1985 | Neuhoff . | |
| 4,561,693 | | 12/1985 | Brownlie et al. . | |
| 4,580,749 | * | 4/1986 | Howard | 248/631 X |
| 4,595,237 | | 6/1986 | Nelsen . | |
| 4,603,905 | | 8/1986 | Stucki . | |
| 4,629,249 | | 12/1986 | Yamaguchi . | |
| 4,640,547 | | 2/1987 | Fromme . | |
| 4,662,680 | | 5/1987 | Dauphin . | |
| 4,709,963 | | 12/1987 | Uecker et al. . | |
| 4,743,065 | | 5/1988 | Meiller et al. . | |
| 4,756,496 | | 7/1988 | Hosan et al. . | |
| 4,779,925 | | 10/1988 | Heinzel . | |
| 4,832,402 | | 5/1989 | Zünd . | |
| 4,840,426 | | 6/1989 | Vogtherr et al. . | |
| 4,858,993 | | 8/1989 | Steinmann . | |
| 5,213,295 | * | 5/1993 | Scholten et al. | 248/161 |
| 5,244,253 | | 9/1993 | Hollington et al. . | |
| 5,577,807 | | 11/1996 | Hodge et al. . | |
| 5,630,649 | | 5/1997 | Heidmann et al. . | |
| 5,740,997 | * | 4/1998 | Van Wieran | 248/161 X |
| 5,915,674 | | 6/1999 | Wolf et al. . | |

FOREIGN PATENT DOCUMENTS

| | | |
|---|---|---|
| 0969221A1 | 6/1991 | (DE) . |

* cited by examiner

*Primary Examiner*—Peter M. Cuomo
*Assistant Examiner*—Stephen Vu
(74) *Attorney, Agent, or Firm*—Price, Heneveld, Cooper, Dewitt & Litton

(57) ABSTRACT

A chair includes a base having a vertically extendable gas spring with an upwardly disposed release button movable horizontally/laterally between a vertically oriented locked position where the gas spring is lock and non-extendable, and a laterally shifted actuated position where the gas spring is released and extendable. A seat is mounted on the gas spring and includes an actuator constructed to selectively move the release button between the locked position and the actuated position with a sideways movement. The actuator includes a link slidably mounted to a control housing under the seat for horizontal movement, and a lever that is pivoted to a side of the control housing for operating the link. The link includes an aperture with angled side surfaces configured to facilitate downward assembly of the link onto the release button, but so that the side surfaces will actuate the release button when the link is moved laterally by the lever.

16 Claims, 7 Drawing Sheets

38
38'
42
41
29
40
39
35
36
32

VERTICAL HEIGHT ADJUSTMENT MECHANISM FOR CHAIRS

BACKGROUND OF THE INVENTION

The present invention relates to vertical height adjustment mechanisms for chairs.

Many existing chairs have vertical height adjustment mechanisms that include vertically extendable gas springs. Typically, the gas spring includes a vertically operated release button that extends above the gas spring into an area under a chair seat, and the seat includes an actuator that can be manipulated by a seated user to depress the release button to unlock the gas spring. Upon release, the gas spring biases the seat upwardly. Alternatively, the seated user can, after unlocking the release button, press downwardly on the chair to overcome the bias of the gas spring to force the seat downwardly. However, the upright vertical position of the release button and its vertical operation cause these known height adjustment arrangements to require significant vertical space above the gas spring and under the seat. This is inconsistent with many modem chair designs, which call for a thin seat construction having sleek lines. Further, the structure necessary to provide the vertical space required for the vertically operated release button results in a heavier chair with more expensive and massive parts. Another problem with known vertical height adjustment mechanisms is that many are relatively complex and intricate, such that they are subject to mis-assembly, quality problems, and/or field failure.

Accordingly, a vertical height adjustment mechanism is desired that is reliable, is relatively non-complex, solves the aforementioned problems, and has the aforementioned advantages.

SUMMARY OF THE INVENTION

In one aspect, the present invention includes a chair having a base that includes a vertically extendable gas spring having a top-mounted release button operably movable between a vertically disposed locked position where the gas spring is locked and non-extendable, and a laterally shifted actuated position where the gas spring is released and extendable. A seat is supported on the base and operably connected to the gas spring for assisted vertical height adjustment. The seat includes an actuator constructed to selectively move the release button laterally from the locked position to the actuated position.

In another aspect, a chair includes a base having a tubular center post and a vertical height adjustment mechanism positioned in the center post, the adjustment mechanism including an upper end and a release button positioned at the upper end. A seat includes an actuator with a link slidably attached to the seat and located horizontally adjacent the release button for horizontal sliding movement to engage and actuate the release button.

In another aspect, a chair includes a base that includes a vertically extendable gas spring having a top-mounted vertically extending release button operably movable between a locked position where the gas spring is locked and non-extendable, and an actuated position where the gas spring is released and extendable. A seat includes an actuator for operating the release button. The actuator has a horizontally extending link with an aperture shaped to vertically engage and receive the release button during assembly. The aperture characteristically has angled sides to facilitate downward installation onto the release button during assembly, but the angled sides having portions defining a narrow width so that the link is constructed to selectively move the release button from the locked position to the actuated position when assembled to the seat and when the actuator is horizontally operated.

In another aspect, a chair includes a base, a control housing, and an actuator. The base includes a vertically extendable gas spring having a top-mounted vertically extending release button operably movable between a locked position where the gas spring is locked and non-extendable, and an actuated position where the gas spring is released and extendable. The control housing has a bottom wall and sidewalls, with the bottom wall including an aperture shaped to mateably engage the gas spring, such that the release button is positioned between the sidewalls. The actuator is configured to engage and operate the release button. Specifically, the actuator includes a link configured to operate the release button, a lever operably connected to the link to operate the link, a pivot-forming bracket attached to one of the sidewalls that pivotally supports the lever, and a spring. The spring is configured to bias the lever toward a first position, where the link does not operate the release button, such that the release button naturally moves to the locked position, but the spring is configured to flex when the lever is moved to a second position, where the link is operated to move the release button to the actuated position.

In yet another aspect, a chair control for a chair having a seat includes a control housing having a tapered socket adapted to engage a matingly tapered end of a cylinder of a gas spring, and an actuator slidably attached to the control housing over the tapered socket. The actuator is configured to slide horizontally, such that the actuator is adapted to laterally and horizontally shift a release button of the gas spring to operate the release button.

These and other features, objects, and advantages of the present invention will become apparent to a person of ordinary skill upon reading the following description and claims together with reference to the accompanying drawings.

DETAILED DESCRIPTION OF PREFERRED EMBODIMENT

Figure 1:
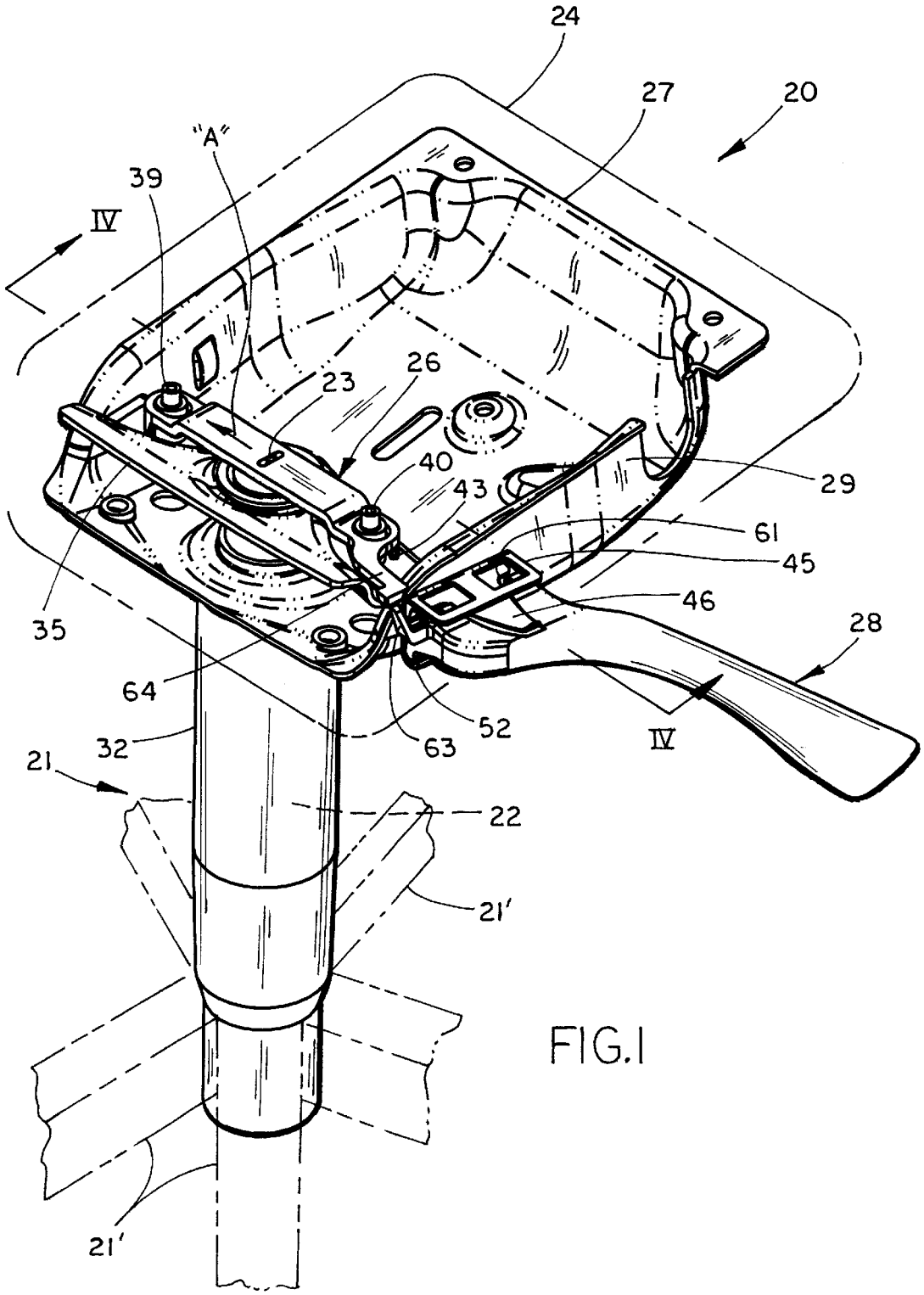
FIG. 1 includes a perspective view of a chair embodying the present invention, the chair including a control housing, a horizontally slidably link, and an actuator lever for biasing the link.

A chair 20 (FIG. 1) includes a base 21 having a vertically extendable gas spring 22 with an upwardly extending release button 23. The release button 23 is operably movable between a vertically disposed locked position where the gas spring 22 is locked and non-extendable, and a laterally moved actuated position where the gas spring 22 is released and extendable. A seat construction 24 is mounted on the gas spring 22 and includes an actuator 25 constructed to selectively move the release button 23 laterally shifted in a direction "A" from the locked position to the actuated position with a sideways, horizontal movement. The seat construction 24 includes a control housing 27. The actuator 25 includes a link 26 slidably mounted to the control housing 27 for horizontal movement, and a lever 28 that is pivoted to a sidewall 29 of the control housing 27 for operating the link 26. The link 26 includes an aperture 30 with angled side surfaces configured to facilitate downward assembly of the link 26 onto the release button 23, but the angled side surface have a portion that defines a narrow side-to-side dimension so that the side surfaces will actuate the release button 23 when the link 26 is moved horizontally laterally by the lever 28. The above components, including in particular the link 26, the housing 27 and the lever 28, form a vertical height adjustment mechanism that is easily assembled, mechanically relatively noncomplex, and easy to operate.

Figure 4:
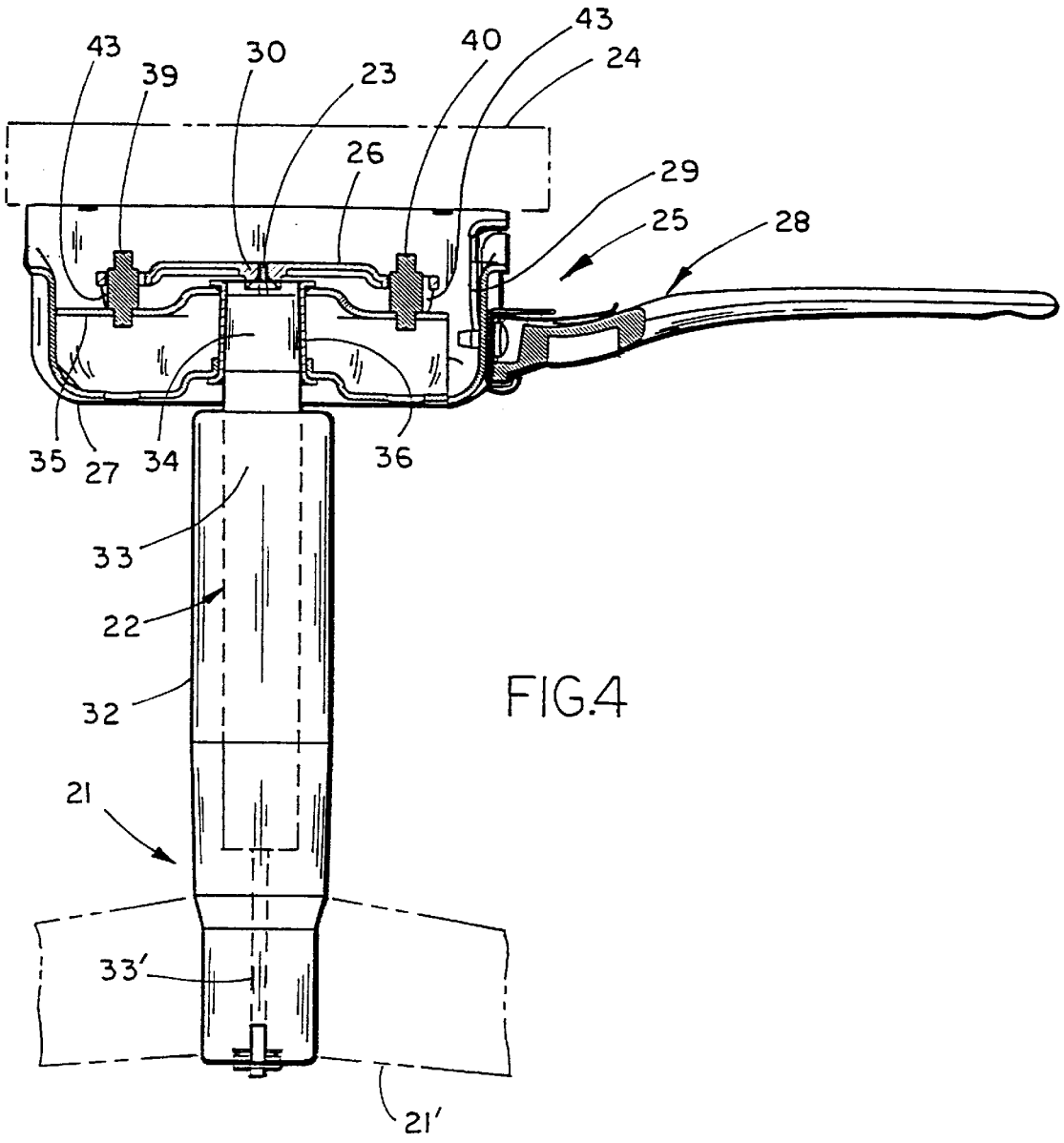
FIG. 4 is a cross-sectional view taken along line IV—IV in FIG. 1.

The illustrated base 21 (FIG. 4) includes a center post 32 supported in an upright position by a leg assembly 21' (see FIG. 1). The gas spring 22 is positioned in the center post 32 and operably supported on the leg assembly 21' by ways known in the art. The gas spring 22 includes a cylinder 33 and an extendable rod 33', with the cylinder 33 having a tapered end section 34 oriented upwardly and the rod 33' extending downwardly and anchored to a hub of the base 21. The release button 23 is located at a top and center of the tapered end section 34. It is contemplated that a scope of the present invention includes different gas spring constructions, but the particular illustrated gas spring 22 advantageously has a release button 23 that can be tipped or shifted horizontally/laterally relative to the cylinder 33, as discussed below. It is noted that gas springs, such as gas springs 22 having a side-shiftable release button, are available in the industry and can be purchased from Suspa Inc., Wyoming, Mich.

Figure 3:
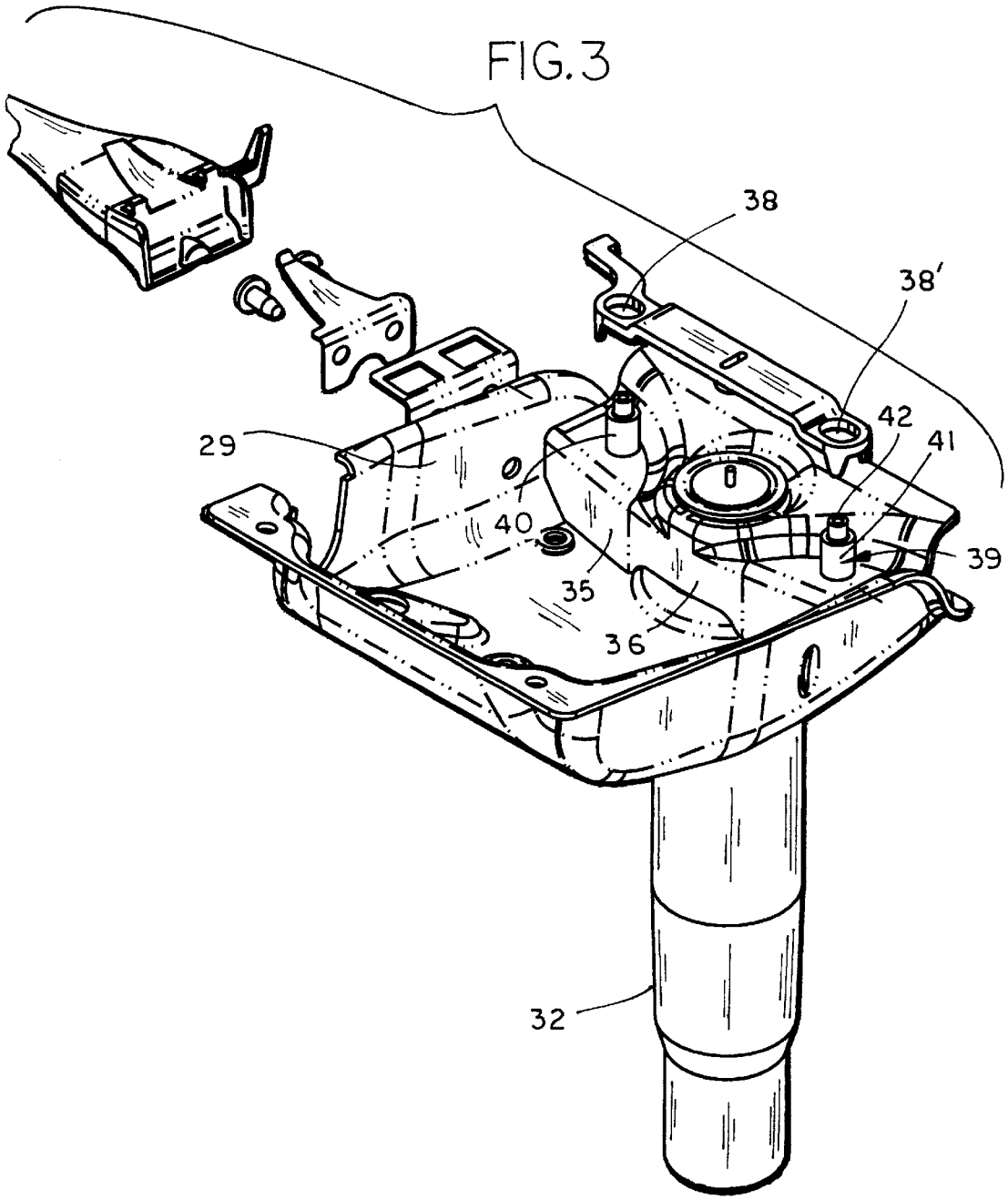

The housing 27 (FIG. 3) is pan-shaped with one side being defined by the sidewall 29. A back (not shown) is pivoted to the housing 27 and structure is provided on the housing 27 for supporting the seat and/or the back as desired. For example, the present invention is at, believed to be very useful on chairs where the seat moves with a synchronous movement during recline of the back. Such back constructions and synchrotilt chair constructions are well known in the art and need not be described herein for an understanding of the present invention. Concurrently, it is specifically contemplated that the present invention can be used in several different chair constructions, such as the synchrotilt chairs described in Knoblock et al. U.S. Pat. No. 5,611,598, Heidmann et al. U.S. Pat. No. 5,630,647, and DeKraker et al. U.S. Pat. No. 5,909,923 (application Ser. No. 08/957,548), and also in non-synchrotilt-type chairs.

An L-shaped mounting channel 35 is welded in an inverted position into a rear section of the illustrated housing 27. The mounting channel 35 defines a tapered socket 36 for matingly engaging the tapered mating top end of cylinder 33, with the release button 23 extending up into a cavity defined by the housing 27 under the seat 24.

Figure 14:
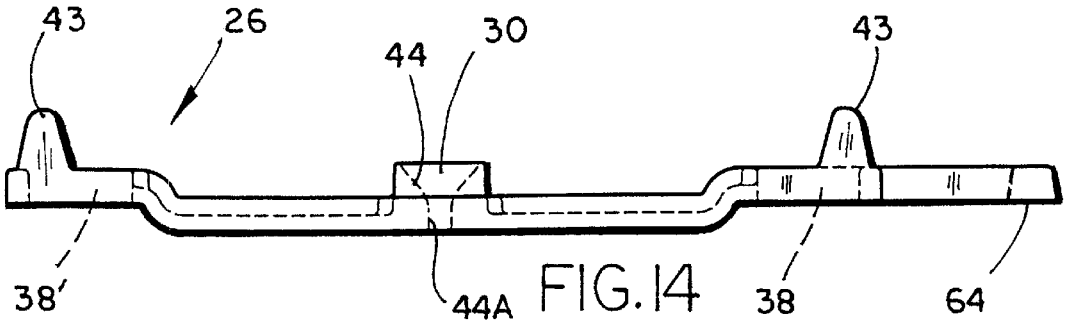
FIGS. 14–16 are side, top, and end views of the link shown in FIG. 1.
Figure 15:
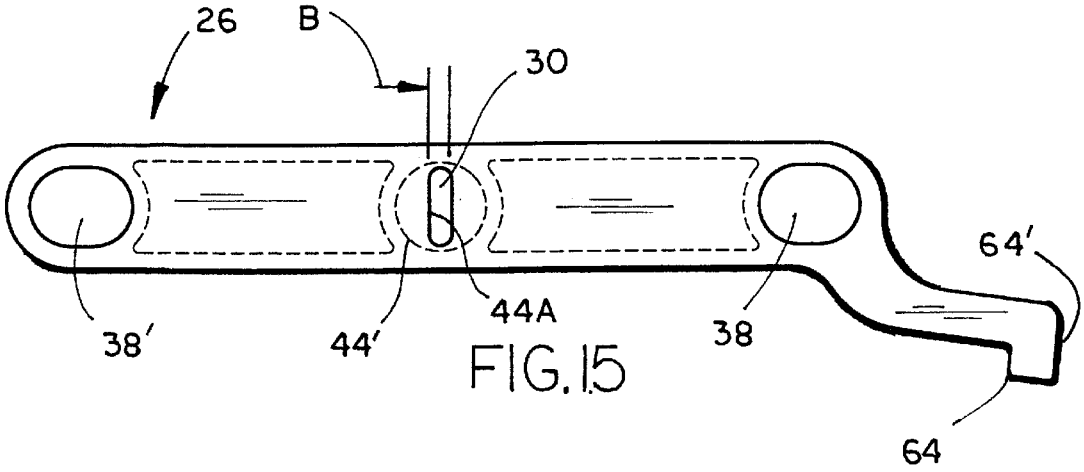
Figure 16:
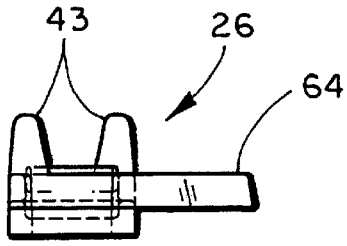

As noted above, the actuator 25 includes the link 26 and the lever 28. The link 26 (FIGS. 14–16) is relatively flat and includes a pair of longitudinally elongated slots 38 and 38' therein. A pair of studs 39 and 40 (FIG. 3) is attached to the mounting channel 35. The studs 39 and 40 each include a cylindrical surface 41 adapted to slidably engage slots 38 and 38' of the link 26, and further include a tip 42 that extends through the slots 38. Fasteners, such as threaded nuts, can be secured to the tips 42 to operably secure the link 26 to the housing 27, although it is contemplated that fasteners do not need to be used if the seat 24 is constructed to be located close enough to the tips 42 to prevent the link 26 from accidental disengagement. The link 26 includes standoffs 43 (FIGS. 4 and 14) that extend downwardly and that slide on a top of the mounting channel 35 (FIG. 4), such that the link 26 is slidably mounted to the housing 27 for horizontal sliding movement.

The aperture 30 (FIG. 14) in link 26 includes down-angled side surfaces 44 that form an enlarged funnel-like target shaped to facilitate assembly of the link 26 downwardly onto the release button 23. This also facilitates replacement of the gas spring 22 in the field, since it is a blind assembly when the release button 23 of the new gas spring 22 is inserted into the aperture 30. The angled side surfaces 44 include portions 44A that define a narrow width dimension so that the link 26 is configured to engage release button 23 for side operation when link 26 is moved laterally/horizontally. Specifically, the bottom of the aperture 30 defines a circle 44', thus providing a relatively large inlet target for engaging the release button 23 during downward assembly of the link 26 onto the housing 27. A top of the aperture 30 defines a transverse slot with its narrow width dimension "B" extending in a longitudinal direction on the link 26 (i.e., so that the release button 23 is engaged during a short, lateral, sideways movement of the link 26) and with its wide dimension extending in a transverse direction (i.e., so that a maximum tolerance is provided for the release button 23 in a fore-aft direction on the housing 27).

Figure 2:
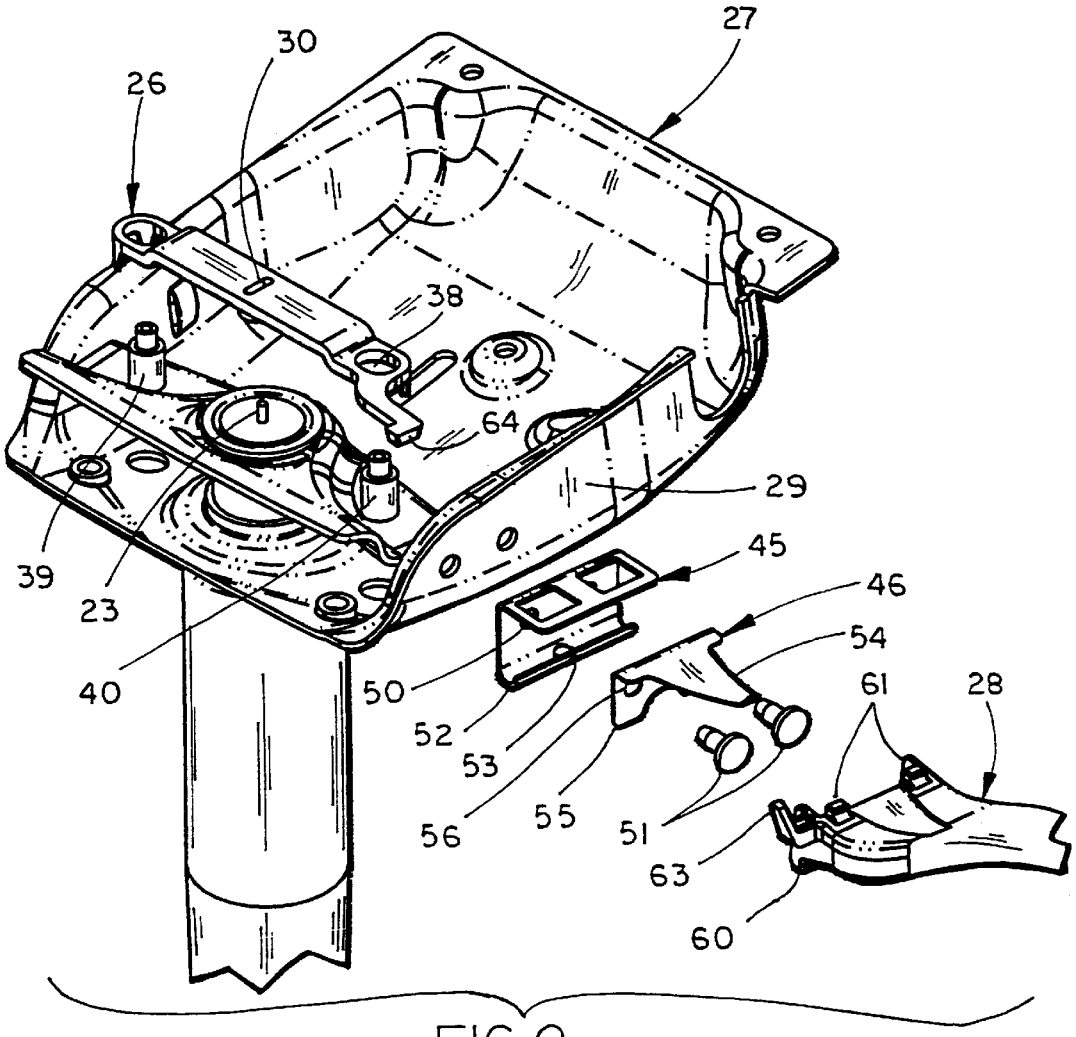
FIGS. 2 and 3 are rear and front exploded perspective views of the housing, the link, the lever, and related components shown in FIG. 1.
Figure 10:
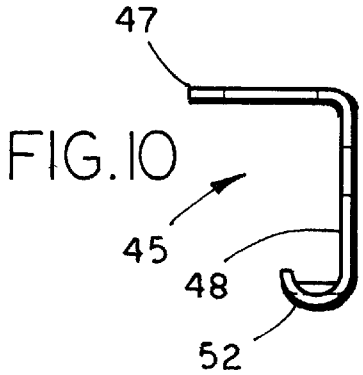
Figure 9:
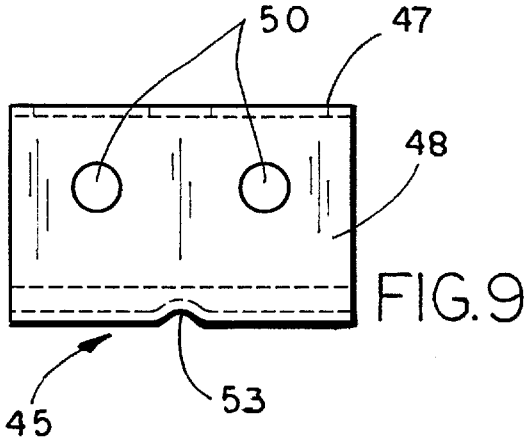
Figure 11:
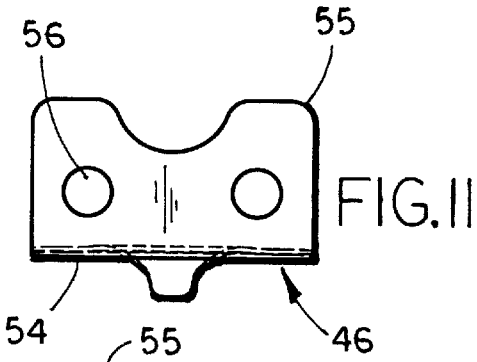
FIGS. 11–13 are side, end, and top views of the leaf spring shown in FIG. 2.
Figure 12:
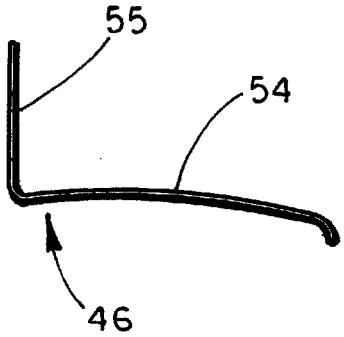
Figure 13:
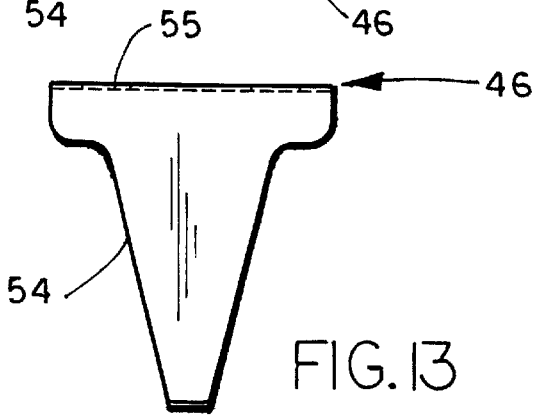

The lever 28 (FIG. 2) is pivoted to a pivot-forming bracket 45 attached to the one sidewall 29 and is spring biased by a leaf spring 46. The pivot-forming bracket 45 (FIG. 10) is L-shaped and includes a horizontal upper leg 47 and a vertical down leg 48. The upper leg 47 includes a pair of windows 49. The down leg 48 engages the one sidewall 29 (FIG. 2) and includes holes 50 that receive fasteners 51 that secure it to the sidewall 29. A curled flange 52 is formed at a bottom of the down leg 48 that defines a semi-cylindrically shaped handle pivot. A stiffening rib 53 is formed into the curled flange 52 for centering the lever 28. The leaf spring 46 (FIGS. 11–13) is also L-shaped and includes a curvilinearly shaped upper leg 54 and a down leg 55. The down leg 55 fits mateably against the down leg 48 of the pivot-forming bracket 45 (FIG. 2) and includes holes 56 that align with the holes 50 and that are engaged by the fasteners 51. The upper leg 54 of the spring 46 extends generally horizontally under upper leg 47 of the bracket 45, but the upper leg 54 is triangularly shaped, such that most of the area of the windows 49 are unobstructed.

Figure 5:
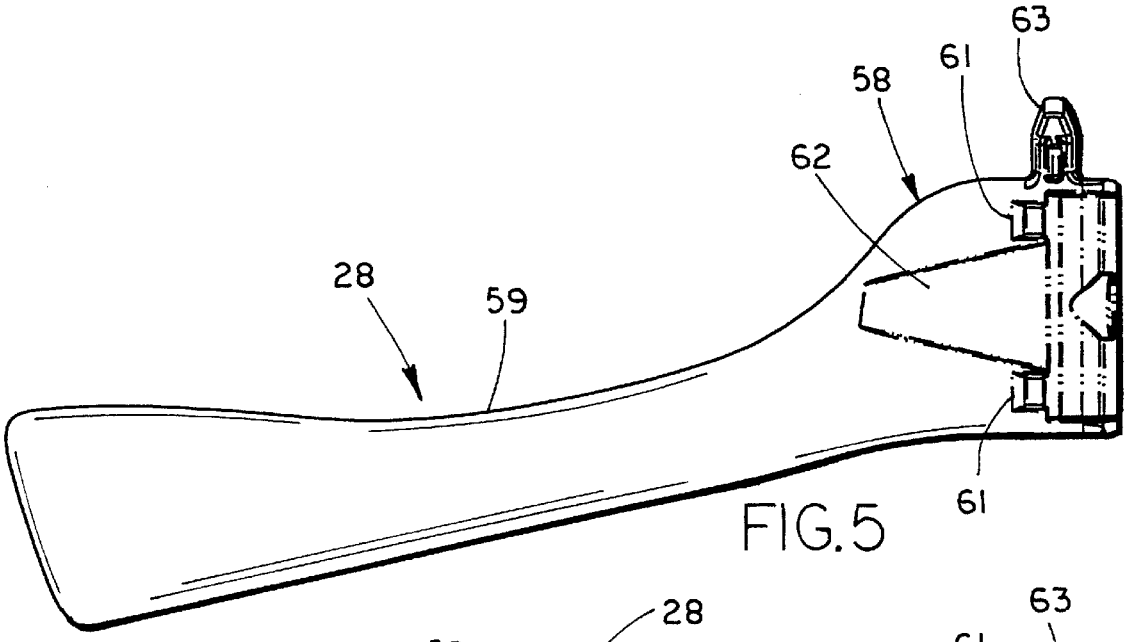
FIGS. 5–7 are top, side, and bottom views of the lever shown in FIG. 1.
Figure 6:
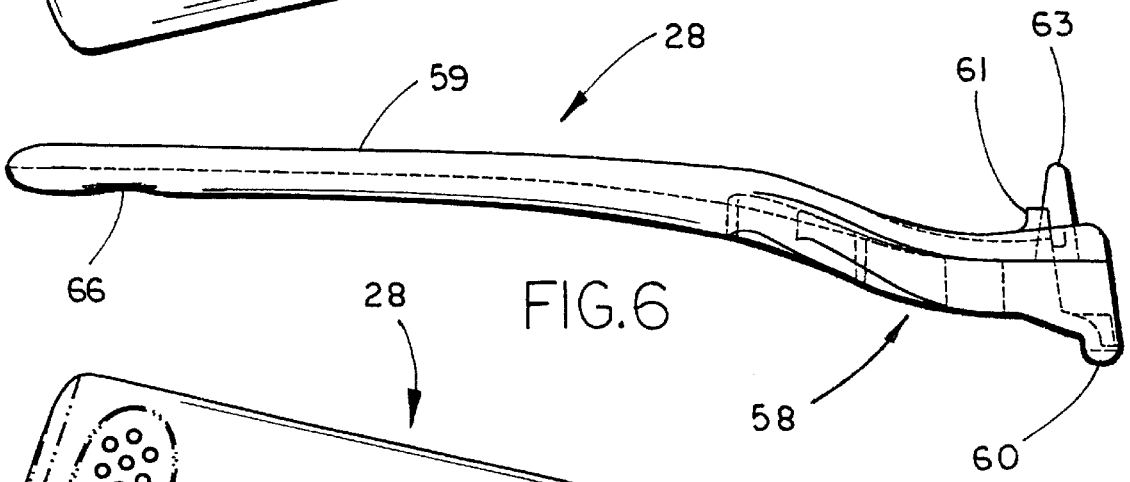
Figure 7:
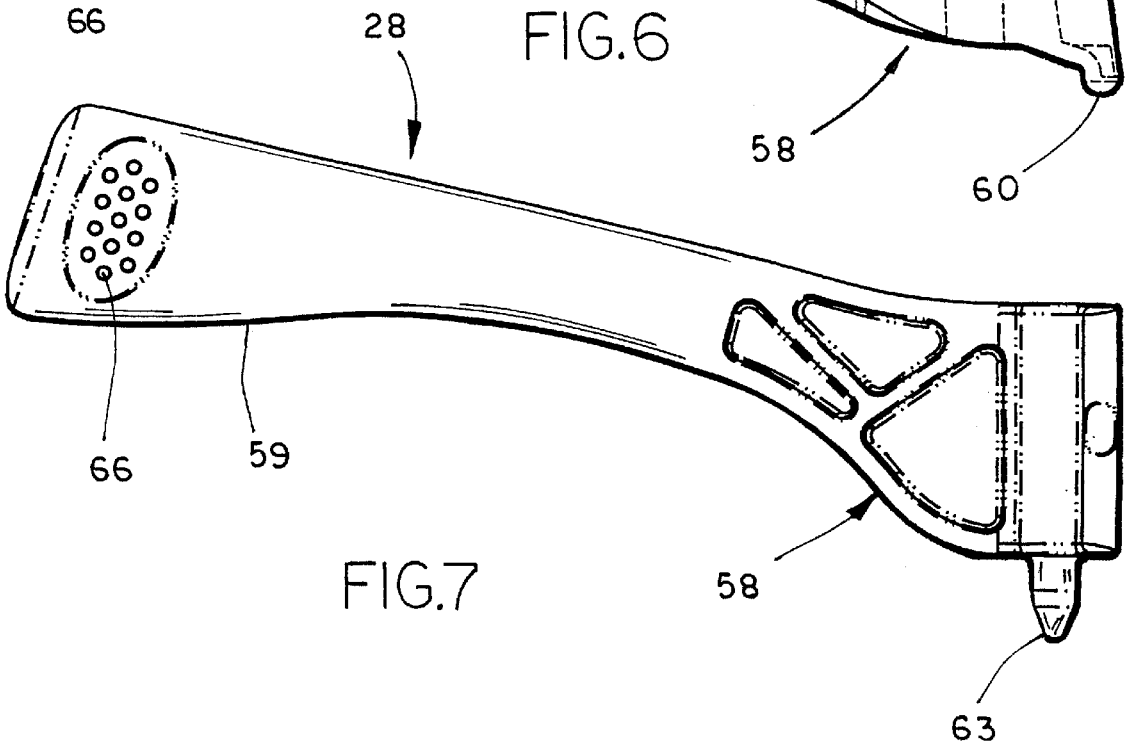
Figure 8:
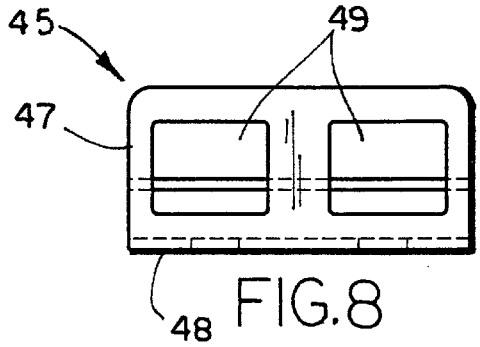
FIGS. 8–10 are top, side, and end views of the pivot-forming bracket shown in FIG. 2.

The lever 28 (FIGS. 5–7) includes a configured end 58 for operably engaging the pivot-forming bracket 45 and the leaf spring 46, and further includes a laterally extending portion forming a handle 59 that is easily grasped by a user seated in the chair 20. The configured end 58 includes a semi-cylindrically shaped bottom ridge 60 that is constructed to rotatably pivotally engage the curled flange 52 for pivotal support of the lever 28. The ridge 60 includes a recess that mateably engages the rib 53 in curled flange 52. Two retainer fingers 61 extend upwardly from the bottom ridge 60 and are spaced apart, such that they straddle the upper leg 54 of the leaf spring 46. The retainer fingers 61 are adapted to rampingly engage and snappingly engage the upper leg 47 of the bracket 45 during assembly as the lever 28 is pivoted on the curled flange 52. The rear surface of the retainer fingers 61 is configured to securely retain the lever 28 to the pivot-forming bracket 45 in an installed position. It is noted that a slight angle can be given to the rear surface to facilitate disassembly if this is a desired feature of the chair, but that is not desired since it could result in accidental disassembly. A recess 62 in the top surface of the configured end 58 is shaped to matingly engage and hold in position the upper leg 54 of the leaf spring 46. The spring 46 biases the lever 28 toward a downwardly pivoted home position, such that the retainer fingers 61 normally engage an outboard edge of the windows 49. A protrusion 63 (FIG. 2) extends upwardly from the configured end 58. The protrusion 63 includes an inboard surface 64' that engages an actuating arm 64 (FIG. 15) on the link 26 when the lever 28 is lifted and rotated upwardly against the bias of spring 46 (see FIG. 1). Notably, the protrusion 63 is offset rearwardly on the configured end 58 so that the handle 59 is located forwardly in a more easily reached position on the housing 27. When released, the spring 46 biases the lever 28 to the lowered home position, and the release button 23 on its own natural action biases the link 26 to its home position. A soft rubber material insert 66 is provided on the handle 59 to improve aesthetics and to provide a more secure grip for a seated user when operating the handle 59.

To operate the present vertical height adjustment mechanism, a seated user lifts the handle 59 against the bias of the spring 46 and the release button 23, which causes the lever 28 to pivot about the curled flange 52 and causes the protrusion 63 to engage actuator arm 64. Fingers 61 move in windows 49, allowing the lever 28 to pivot. The force on actuator arm 64 causes the link 26 to slide horizontally, laterally on the mounting channel 35, guided by the studs 39 and 40. The link 26 engages the release button 23, causing the gas spring 22 to release and extend (or contract if forced downwardly). When released, the natural bias of the release on button 23 and the leaf spring 46 cause the link 26 and the lever 28 to move to their home positions, allowing the gas spring 22 to re-lock with the seat 24 in a selected vertical position.

In the foregoing description, it will be readily appreciated by persons skilled in the art that modifications may be made to the invention without departing from the concepts disclosed herein. Such modifications are to be considered as included in the following claims, unless these claims by their language expressly state otherwise.

The invention claimed is:

1. In a chair having a base including a vertically extendable gas spring having a top-mounted release button operably movable between a vertically disposed locked position where the gas spring is locked and non-extendable, and a laterally shifted actuated position where the gas spring is released and extendable; and a seat including a control housing supported on the base and connected to the gas spring for assisted vertical height adjustment, the seat including an actuator constructed to selectively move the release button laterally from the locked position to the actuated position, an improvement comprising:

the actuator includes a laterally shiftable link, one of the link and the control housing including slots, and the other of the link and the control housing including mating structure slidably engaging the slots for guiding lateral movement of the link.

2. The chair defined in claim 1, wherein the link is slidably supported for horizontal movement in a side-to-side direction relative to the seat.

3. The chair defined in claim 1, wherein the link includes the slots that operably slidably engage the mating structure on the control housing.

4. The chair defined in claim 3, wherein the lever is constructed to engage and push the link with mechanical advantage.

5. The chair defined in claim 4, wherein the lever is pivoted to a sidewall of the control housing on a pivot, and includes a finger spaced from the pivot that engages the link.

6. The chair defined in claim 1, wherein the link is slidably attached to the seat on opposite sides of the release button for linear movement transverse to the gas spring and the release button.

7. In a chair having a base including a tubular center post and a vertical height adjustment mechanism positioned in the center post, the adjustment mechanism including an upper end and a laterally shiftable release button positioned at the upper end; and a seat including an actuator; an improvement comprising:

the actuator including a link slidably attached to the seat and located horizontally adjacent the laterally shiftable release button for horizontal sliding movement to engage and actuate the laterally shiftable release button, and further including a lever pivoted to the seat and operably engaging the link for biasing the link with mechanical advantage when the lever is pivoted.

8. In a chair having a base including a vertically extendable gas spring having a top-mounted vertically extending release button operably movable between a locked position where the gas spring is locked and non-extendable, and a laterally shifted actuated position where the gas spring is released and extendable; and a seat including an actuator for operating the release button, the actuator including an improvement comprising:

a horizontally extending link with an aperture shaped to vertically engage and receive the release button during assembly, the aperture characteristically having angled sides to facilitate downward installation onto the release button during assembly, but the angled sides having portions defining a narrow width in a direction of movement of the link so that the link is constructed to selectively move the release button from the locked position to the laterally shifted actuated position when assembled to the seat and when the actuator is horizontally operated, the aperture also being elongated in a second direction perpendicular to the direction of movement to assist in assembly.

9. The chair defined in claim 8, wherein the actuator includes a link slidably attached to the seat on opposite sides of the release button for linear movement transverse to the gas spring and the release button.

10. In a chair having a base including a vertically extendable gas spring having a top-mounted vertically extending release button operably movable between a locked position where the gas spring is locked and non-extendable, and an actuated position where the gas spring is released and extendable; a control housing having a bottom wall and sidewalls, the bottom wall including an aperture shaped to mateably engage the gas spring, such that the release button is positioned between the sidewalls; and an actuator configured to engage and operate the release button;

an improvement wherein the actuator includes a link configured to operate the release button, a lever operably connected to the link to operate the link, a pivot-forming bracket attached to one of the sidewalls that pivotally supports the lever, and a spring, the spring biasing the lever to a first position, where the link does not operate the release button, such that the release button naturally moves to the locked position, but the spring being configured to flex when the lever is moved to a second position, where the link is operated to move the release button to the actuated position.

11. In a chair having a base including a vertically extendable gas spring having a top-mounted release button operably movable between a vertically locked position where the gas spring is locked and non-extendable, and a laterally shifted actuated position where the gas spring is released and extendable; and a seat supported on the base and operably connected to the gas spring for assisted vertical height adjustment, the seat including an actuator constructed to selectively move the release button laterally from the locked position to the actuated position;

an improvement wherein the actuator includes a laterally shiftable link;

wherein the link includes slots that are operably slidably engaged by mating structure on a control housing;

wherein the actuator includes a lever constructed to engage and push the link;

wherein the lever is pivoted to a sidewall of the housing on a pivot, and includes a finger spaced from the pivot that engages the link; and including a spring that engages and biases the lever to a position where the release button is not operated.

12. The chair defined in claim 11, wherein the link is operably slidably supported on the housing for linear movement.

13. The chair defined in claim 12, wherein the link is slidably supported for horizontal movement in a side-to-side direction relative to the seat.

14. The chair defined in claim 11, wherein the spring comprises a leaf spring.

15. The chair defined in claim 11, wherein the actuator includes a link slidably attached to the seat on opposite sides of the release button for linear movement transverse to the gas spring and the release button.

16. The chair defined in claim 11, wherein the actuator includes a link slidably attached to the seat for horizontal linear movement to actuate the release button.

* * * * *